US010711994B2

(12) United States Patent
Ristic et al.

(10) Patent No.: US 10,711,994 B2
(45) Date of Patent: Jul. 14, 2020

(54) SYSTEM, METHOD AND APPARATUS FOR SOLID FUEL IGNITION

(71) Applicant: GENERAL ELECTRIC TECHNOLOGY GMBH, Baden (CH)

(72) Inventors: Dragisa Ristic, Wendlingen (DE); Hans-Peter Schommer, Althütte (DE); Frank Kluger, Schwäbisch Gmünd (DE)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 737 days.

(21) Appl. No.: 15/410,042

(22) Filed: Jan. 19, 2017

(65) Prior Publication Data

US 2018/0202649 A1 Jul. 19, 2018

(51) Int. Cl.

| | |
|---|---|
| ***F23B 90/02*** | (2011.01) |
| ***F23Q 3/00*** | (2006.01) |
| ***F23D 1/00*** | (2006.01) |

(52) U.S. Cl.

CPC ..... *F23B 90/02* (2013.01); *F23D 1/00* (2013.01); *F23Q 3/00* (2013.01); *F23D 2900/00014* (2013.01)

(58) Field of Classification Search

CPC ..... F23D 1/00; F23D 2207/00; F23D 2900/00014; F23D 2900/00015; F23D 2201/20; F23D 2201/00; F23C 2900/03005; F23C 2900/99005; F23Q 13/00; F23Q 7/02

See application file for complete search history.

(56) References Cited

U.S. PATENT DOCUMENTS

| | | | | |
|---|---|---|---|---|
| 4,836,772 | A | 6/1989 | LaRue | |
| 4,951,581 | A | 8/1990 | Wiest | |
| 5,156,100 | A | 10/1992 | Pentti | |
| 5,697,306 | A | 12/1997 | LaRue et al. | |
| 2015/0226431 | A1* | 8/2015 | Ristic | F23Q 3/00 431/6 |

FOREIGN PATENT DOCUMENTS

| | | | |
|---|---|---|---|
| EP | 2172706 | A1 | 4/2010 |
| EP | 2253884 | A1 | 11/2010 |
| RU | 2 200 905 | C2 | 3/2003 |
| WO | 2007101427 | A1 | 9/2007 |

OTHER PUBLICATIONS

International Search Report and Written Opinion issued in connection with corresponding PCT Application No. PCT/EP2018/050741 dated Apr. 10, 2018.

* cited by examiner

*Primary Examiner* — Jorge A Pereiro

(74) *Attorney, Agent, or Firm* — Grogan, Tuccillo & Vanderleeden, LLP

(57) ABSTRACT

An ignition system includes a pulverized fuel pipe receiving a mixture of pulverized fuel and primary air for injection into a combustion chamber for combustion, and an igniter received within the pulverized fuel pipe for igniting the mixture. The igniter is axially movable within the pulverized fuel pipe.

15 Claims, 5 Drawing Sheets

SYSTEM, METHOD AND APPARATUS FOR SOLID FUEL IGNITION

BACKGROUND

Technical Field

Embodiments of the invention relate generally to combustion systems and, more particularly, to a system, method and apparatus for solid fuel ignition in a solid fuel fired power plant.

Discussion of Art

A boiler typically includes a furnace in which fuel is burned to generate heat to produce steam. The combustion of the fuel creates thermal energy or heat, which is used to heat and vaporize a liquid, such as water, into steam. The generated steam may be used to drive a turbine to generate electricity. Solid fuels, such as pulverized coal, are typical fuels used in many combustion systems for boilers. For example, in an air-fired pulverized coal boiler, atmospheric air is fed into the furnace and mixed with the pulverized coal for combustion.

Existing solid-fuel fired boilers of power plants are provided with several burners. The primary proportion of the boiler energy output is produced by main burners which deliver the major quantity of fuel used for firing the boiler. In addition, igniting burners such as gas or oil torches are typically used for preheating during starting operation, after which the feed of solid fuel into the boiler can be initiated, and for ensuring continuous combustion of the solid fuel during boiler operation. The main burners in the boiler are mounted to an opening in the boiler wall, while the igniting torches/burners are typically placed in the center of the main burner. During the warm-up phase the boiler is heated by the flame of the igniting burner. When required, the igniting burner is used in the steady-state operation of the boiler for ensuring the continuous combustion of the main fuel.

More recently, solid fuel ignition technology has been developed in an effort to replace conventional oil or gas ignitions systems which consume a significant amount of oil/gas and contribute significantly to operating costs. For example, in order to be able to ignite pulverized fuels, fossil fuels or biomass (hereinafter referred to collectively as "pulverized fuels"), plasma igniting systems using a stage by stage ignition process have been developed. In one such known plasma ignition system, in a pulverized fuel nozzle, a plasma cloud first ignites the pulverized fuel contained in a primary air flow entering into a first ignition stage, thereby generating a first stage flame. The generated flame further ignites the pulverized fuel contained in the primary air flow in a second stage, thereby forming a second stage flame. Finally, the ignited fuel enters into the furnace and reacts with oxygen in the combustion air supplied through the burner, thereby forming the last stage flame.

While these plasma ignition systems have been successful in helping to reduce operating costs by decreasing the amount of oil/gas needed to support boiler operation, existing stage-by-stage pulverized fuel nozzles cannot be used across a wide range of fired fuels. In particular, each nozzle requires careful design of the ignition stages, the number of ignition stages, and plasma or micro oil power range, which are themselves dependent on the quality of the solid fuel which is to be ignited or burnt. Accordingly, each fuel nozzle is only suited to a particular design fuel or design fuel range, and cannot be used across a wide range of fired fuels.

Moreover, existing stage-by-stage pulverized fuel nozzles are not well suited for use in boilers with round burners. Round burners typically have a core air pipe inside the pulverized fuel pipe. Highly concentrated pulverized fuel is transported by air through the pulverized fuel pipe via an annular gap between the outer wall of the core air pipe and the inner wall of the pulverized fuel pipe. This annular gap with a high concentration of pulverized fuel in transport air is an important design element of round burners, as it supports low nitrogen oxide ($NO_x$) combustion. If such a round burner were equipped with a stage-by-stage pulverized fuel nozzle, the annular gap with the highly concentrated fuel would be eliminated, affecting the ability to achieve low $NO_x$ combustion.

In view of the above, there is a need for a system, method and apparatus for igniting solid fuels in a round burner without the need for oil or gas preheating, and which both preserves the advantages of low-$NO_x$ combustion and which can be adjusted for use with a wide range of fired fuels.

BRIEF DESCRIPTION

In an embodiment, an ignition system is provided. The ignition system includes a pulverized fuel pipe receiving a mixture of pulverized fuel and primary air for injection into a combustion chamber for combustion, and an igniter received within the pulverized fuel pipe for igniting the mixture. The igniter is axially movable within the pulverized fuel pipe.

In another embodiment, a method for igniting a solid fuel is provided. The method includes the steps of providing a mixture of pulverized fuel and primary air to a pulverized fuel pipe having an outlet end, igniting the mixture with an igniter received axially within the pulverized fuel pipe, and varying an ignition residence time of the mixture by axially moving the igniter within the pulverized fuel pipe to vary a distance of a forward end of the igniter with respect to the outlet end of the pulverized fuel pipe.

In yet another embodiment, a burner for a combustion system is provided. The burner includes a pulverized fuel pipe receiving a mixture of pulverized fuel and primary air for injection into a combustion chamber for combustion, and an igniter received within the pulverized fuel pipe for igniting the mixture. The igniter is movable axially within the pulverized fuel pipe.

DRAWINGS

The present invention will be better understood from reading the following description of non-limiting embodiments, with reference to the attached drawings, wherein below:

DETAILED DESCRIPTION

Figure 1:
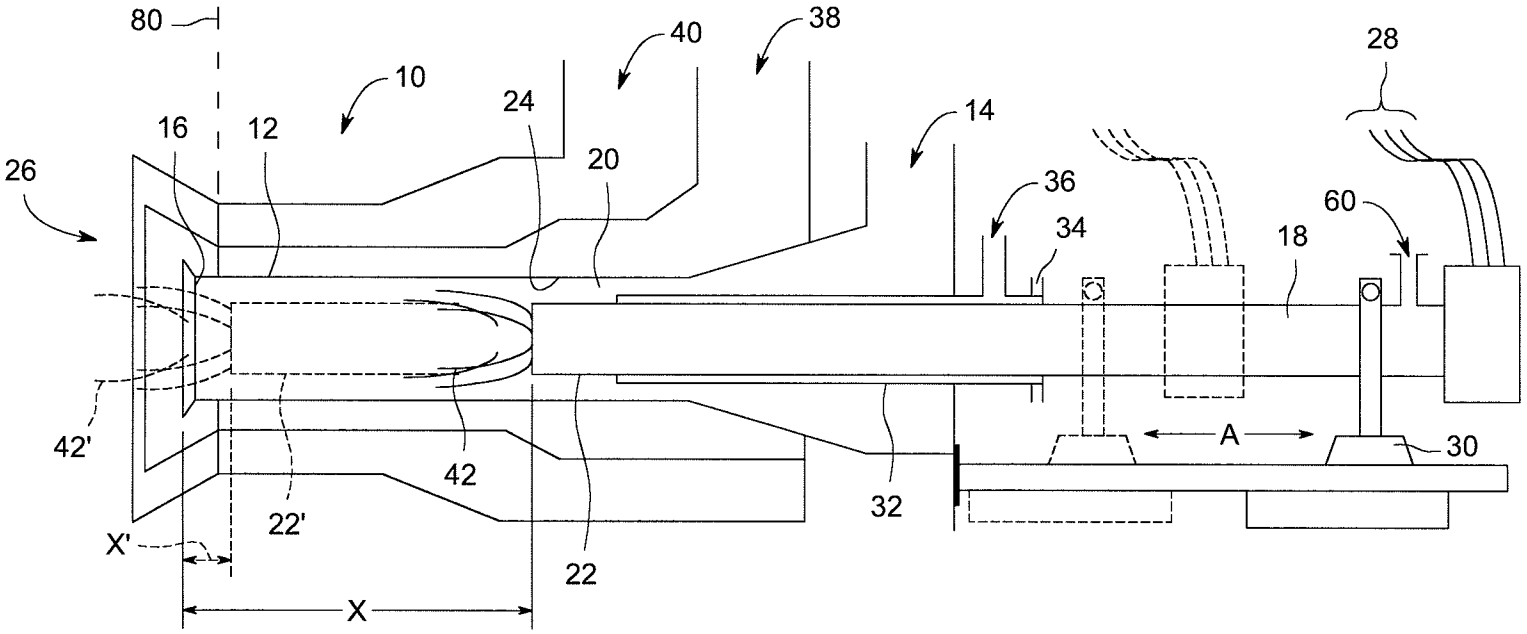
FIG. 1 is a schematic illustration of a system for solid fuel ignition, according to an embodiment of the invention.

Reference will be made below in detail to exemplary embodiments of the invention, examples of which are illustrated in the accompanying drawings. Wherever possible, the same reference characters used throughout the drawings refer to the same or like parts. While embodiments of the invention are suitable for use with combustion systems, generally, a solid fuel fired boiler has been selected for clarity of illustration. Other combustion systems may include other types of boilers, furnaces and fired heaters utilizing a wide range of solid fuels including, but not limited to fossil fuels such as coal, biomass, etc.

As used herein, "electrical communication" or "electrically coupled" means that certain components are configured to communicate with one another through direct or indirect signaling by way of direct or indirect electrical connections. As used herein, "mechanically coupled" refers to any coupling method capable of supporting the necessary forces for transmitting torque between components. As used herein, "operatively coupled" refers to a connection, which may be direct or indirect. The connection is not necessarily being a mechanical attachment. As used herein, directions such as "downstream" and "forward" means in the general direction of fuel and air. Similarly, the term "upstream," "rearward" or "backward" is opposite the direction of "downstream" going opposite the direction of fuel and air flow. As used herein, "ignition residence time" means the amount of time that ignited pulverized fuel spends in the pulverized fuel pipe before entering the combustion chamber.

Embodiment of the invention relate to a system, method and apparatus for single stage solid fuel ignition where ignition residence time within the single ignition stage may be selectively varied. The system includes a pulverized fuel pipe receiving a mixture of pulverized fuel and primary air for injection into a combustion chamber for combustion, and an igniter received within the pulverized fuel pipe for igniting the mixture. The igniter is axially movable within the pulverized fuel pipe for varying an ignition residence time of the mixture.

FIG. 1 illustrates a pulverized fuel burner 10 according to an embodiment of the invention. In an embodiment, the burner 10 is a round burner and may be mounted on a wall of a boiler (e.g., boiler 80) of a pulverized fuel (e.g., coal, biomass, etc.) fired power plant. The boiler may be a tangentially fired boiler (also known as a T-fired boiler) or wall fired boiler. T-firing is different from wall firing in that it utilizes burner assemblies with fuel admission compartments located at the corners of the boiler furnace, which generates a rotating fireball that fills most of the furnace cross section. Wall firing, on the other hand, utilizes burner assemblies that are perpendicular to a side of the boiler. The power plant may be utilized, for example, for electric power generation.

As shown in FIG. 1, the burner 10 includes a pulverized fuel pipe 12 having an inlet or annular passageway 14 for receiving a mixture of pulverized fuel and primary air for transport to an outlet 16 in fluid communication with a combustion chamber 26 of the boiler, as discussed in detail below. The burner 10 further includes a movable igniter lance 18 arranged substantially concentrically within the pulverized fuel pipe 12, and which defines therewith an annular gap 20 between an outer wall 22, 22' of the igniter lance 18 and an inner wall 24 of the pulverized fuel pipe 12. In an embodiment, the igniter lance 18 is a plasma igniter or plasma torch coupled to a supply 28 of electrical power. In other embodiments, the igniter lance 18 may use other fuels for generating a flame such as, for example, oil, gas or solid fuel.

The igniter lance 18 is configured with a moving mechanism 30 for moving the igniter lance 18 axially within the pulverized fuel pipe 12 towards and away from outlet 16, as indicated by arrow A. In particular, as shown in FIG. 1, the moving mechanism 30 may be operatively connected to the igniter lance 18 for imparting a linear force on the igniter lance 18 to move the igniter lance 18 axially within the pulverized fuel pipe 12. In an embodiment, the moving mechanism 30 may be a pneumatic piston, electric linear actuator, linear drive screw or similar mechanical moving mechanism operatively connected to the igniter lance 18 for moving the igniter lance linearly within the pulverized fuel pipe 12, as discussed hereinafter.

In an embodiment, the igniter lance 18 may be received in a cylindrical sleeve or hosting pipe 32 having an adjustable flange 34 coupled to a rearward end thereof. The adjustable flange 34 provides a gas-tight connection between the igniter lance 18 and the burner. The sleeve 32 also includes an inlet 36 adjacent the rearward end for receiving a flow of purge air that is passed from the inlet 36 to the forward end of the igniter lance 18 between the outer wall 22 of the igniter lance 18 and the inner wall of the sleeve 32. Purge air functions to keep the sleeve 32 clean (i.e., it prevents the accumulation of coal therein), therefore preventing choking of the igniter 18 within the sleeve 32.

As further illustrated in FIG. 1, the burner 10 may also include passageways 38, 40 for secondary and tertiary air flows for passage into the combustion chamber 26 to support combustion of the pulverized fuel, as discussed in detail hereinafter.

In operation, as a flow of pulverized fuel and primary air enters through inlet 14 and passes through the annular gap 20, the igniter lance 18 is controlled to produce a flame 42, 42' (or a plasma cloud in the case that the igniter lance 18 is a plasma igniter) in the pulverized fuel pipe 12 which ignites the pulverized fuel contained in the primary air flow downstream from the annular gap 20, thereby generating a pulverized fuel ignition flame. After leaving the pulverized fuel pipe 12 through outlet 16, the ignited fuel enters into the combustion chamber 26 and reacts with oxygen in secondary air and tertiary air (also referred to as combustion air) supplied through the secondary air passageway 38 and tertiary air passageway 40 of the burner 10, thereby forming a pulverized fuel flame. The burner 10 of the invention therefore has only a single ignition stage.

The burner 10 of the invention is controllable so that the residence time of the ignited fuel (i.e., ignition residence time), the amount of time the ignited pulverized fuel spends in the pulverized fuel pipe 12, can be varied. In particular, the residence time of the ignited fuel can be selectively varied by moving the igniter lance 18 back and forth axially within the pulverized fuel pipe 12 utilizing moving mechanism 30, as discussed in detail hereinafter. This has the effect of increasing or decreasing the temperature within the pulverized fuel pipe 12 for supporting burner starting operation or burner stable operation/combustion, as discussed in detail hereinafter.

In particular, in order to control the ignition process and the temperature within the pulverized fuel pipe 12, the igniter lance 18 is moved rearward and forward utilizing the moving mechanism 30. To increase pulverized fuel ignition residence time and support pulverized fuel and primary air ignition, the igniter lance 18 is moved rearwards, away from the outlet 16. This has the effect of increasing the temperature within the pulverized fuel pipe 12. For example, the igniter lance 18 may be moved rearward to the position illustrated in solid lines in FIG. 1 for starting operation. In this position, the forward end of the igniter lance 18 is at a distance, x, from the outlet of the pulverized fuel pipe 12 and the longitudinal extent of the annular gap 20 is at its minimum.

The igniter lance 18 may likewise be moved forward, toward the outlet 16 to decrease pulverized fuel ignition residence time and decrease pulverized fuel and primary air ignition intensity, thereby decreasing the temperature within the pulverized fuel pipe 12. In one embodiment, for example, once the burner 10 is brought up to stable operation, the igniter lance 18 may be switched off and moved forward to the outlet 16 (illustrated by the dashed lines) in order to extend the longitudinal or axial extent of the annular gap 20. In this position, the forward end of the igniter lance 18 is at a distance, x', from the outlet of the pulverized fuel pipe 12 and the longitudinal extent of the annular gap 20 is at its maximum. This ensures that the annular gap 20 is maintained to provide for low-$NO_x$ combustion, as discussed above.

Figure 2:
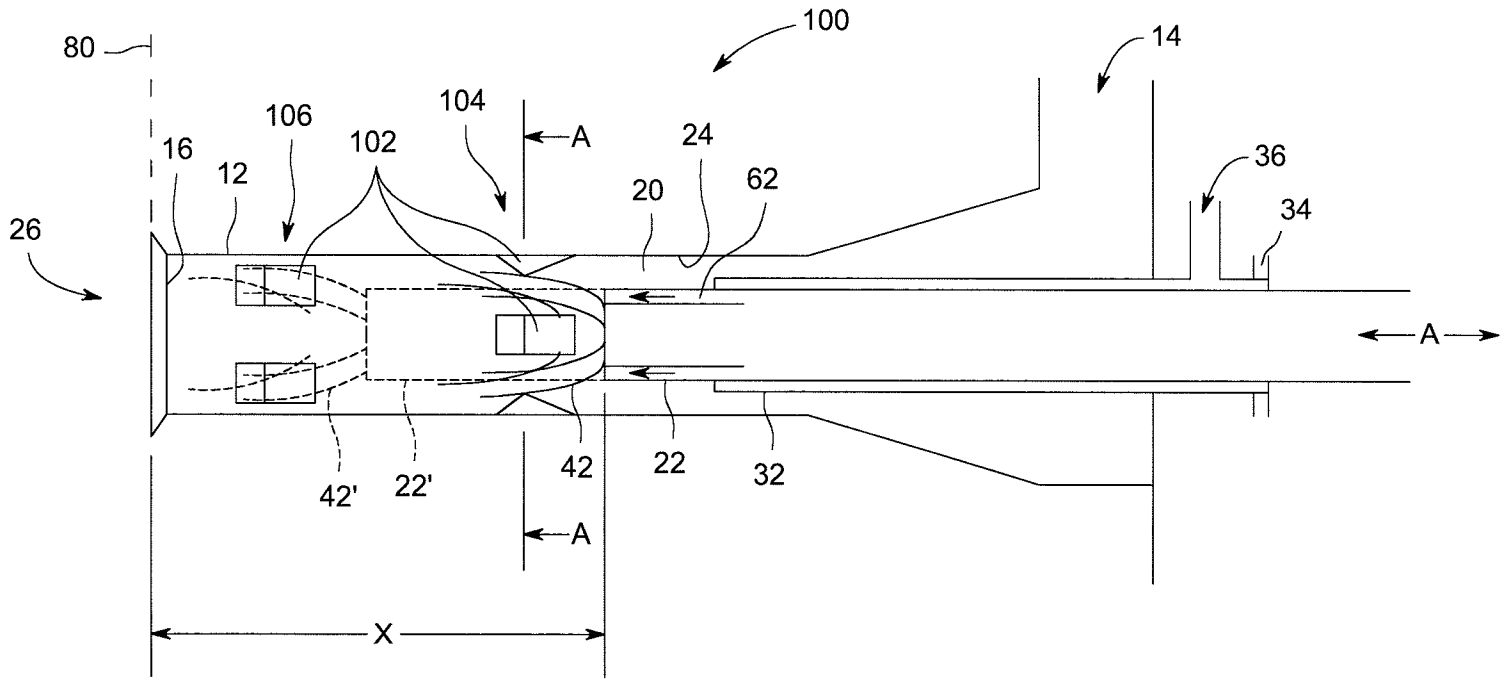
FIG. 2 is a schematic illustration of a system for solid fuel ignition, according to another embodiment of the invention.

As further illustrated in FIGS. 1 and 2, in an embodiment, the igniter lance 18 may also include an inlet 60 for injecting circumferential air 62 into the igniter lance 18. By controlling the amount of circumferential air (such as with a valve associated with the inlet), the pulverized fuel flow in the vicinity of the igniter outlet can be controller. For example, in order to increase pulverized fuel ignition the circumferential air provided through inlet 60 can be reduced and therefore the pulverized fuel can easily flow into the igniter flame 42 in the igniter outlet vicinity. In order to decrease pulverized fuel ignition the circumferential air can be increased to discourage/minimize the pulverized fuel flow into the igniter flame 42 in the igniter outlet vicinity (and push the point at which the fuel contacts the igniter flame and is combusted further downstream toward outlet 16). Furthermore, in the case of an inert transport gas (oxygen concentration reduced) and pulverized fuel mixture, the circumferential air can be utilized as ignition support air since it provides additional oxygen locally into transport gas and pulverized fuel mixture.

Figure 3:
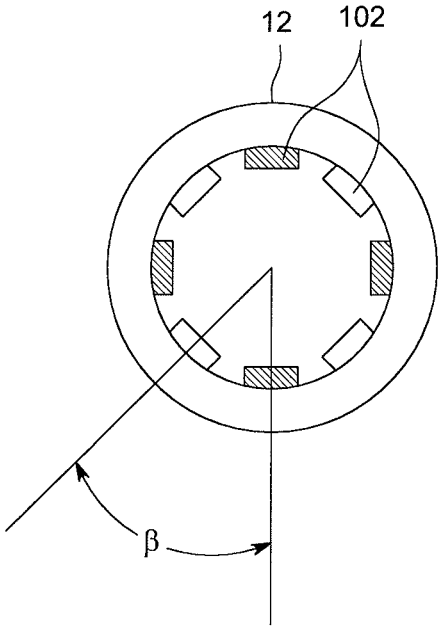
FIG. 3 is a cross-sectional view of the system for solid fuel ignition, taken along line A-A of FIG. 2.

Turning now to FIGS. 2 and 3, a portion of a burner 100 according to another embodiment of the invention is illustrated. The burner 100 is substantially similar to burner 10 described above in connection with FIG. 1, where like reference numerals designate like parts. As shown in FIG. 2, however, the pulverized fuel pipe 12 may be equipped with a plurality of projections or kickers 102 that extend inwardly from the inner wall 24 of the pipe 12. The kickers 102 function to direct the pulverized fuel flow as it exits the annular gap 20 into the igniter flame 42, thereby increasing ignition intensity. As shown in FIG. 2, the kickers 102 may be arranged in two or more rows (e.g., first kicker row 104 and second kicker row 106) at axially spaced locations within the pulverized fuel pipe 12. As illustrated in FIG. 3, the kickers 102 within each row are pitched or offset relative to the kickers 102 of each immediately adjacent row. For example, the kickers 102 within the second row 106 are radially offset by an angle, β, with respect to the kickers 102 within the first row 104. In an embodiment, the offset angle, β, may be greater than about 0° and, more particularly, greater than about 10°.

Figure 4:
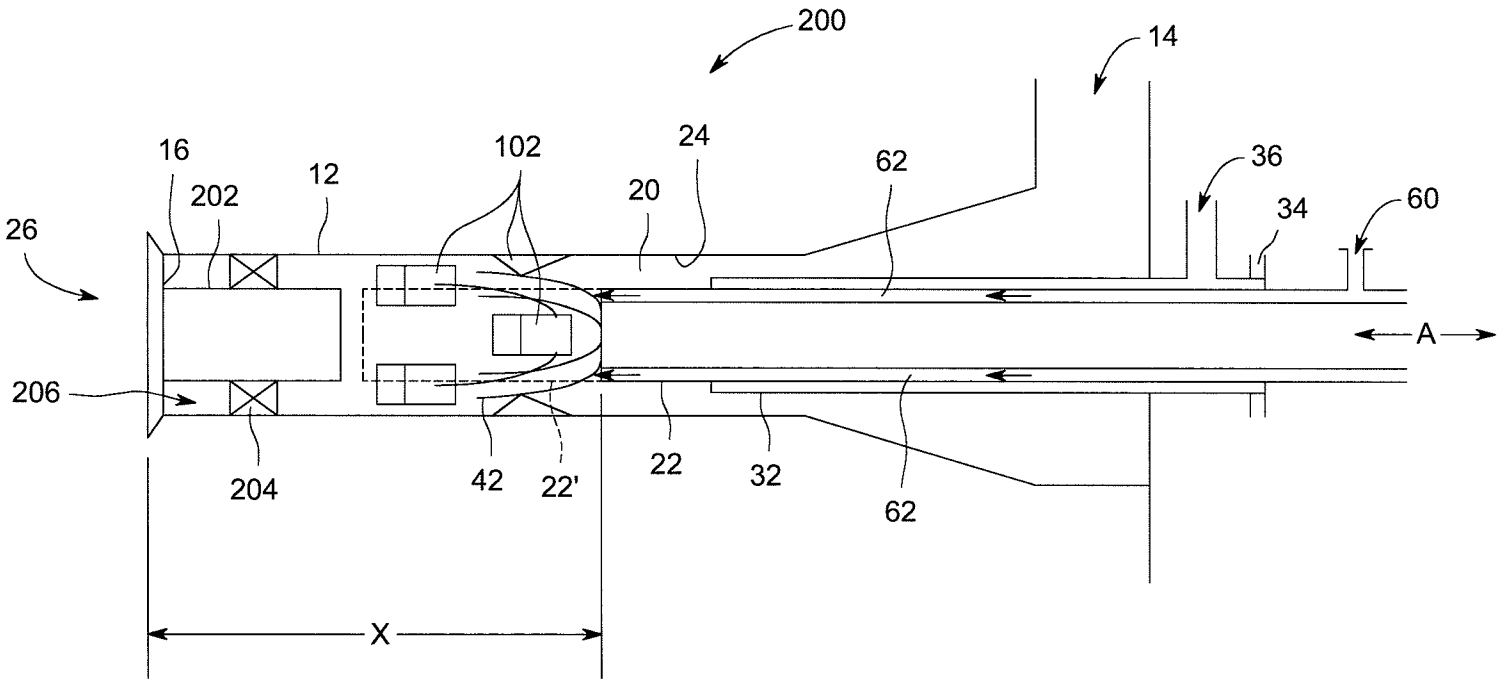
FIG. 4 is a schematic illustration of a system for solid fuel ignition, according to another embodiment of the invention.

Referring to FIG. 4, a portion of a burner 200 according to another embodiment of the invention is illustrated. The burner 200 is substantially similar to burner 10 described above in connection with FIGS. 1-3, where like reference numerals designate like parts. As shown in FIG. 4, however, the pulverized fuel pipe 12 is equipped with a pulverized fuel concentrator 202 interior to the pulverized fuel pipe 12 downstream from the igniter lance 18. The pulverizer fuel concentrator 202, for example, may be concentrically arranged with the pulverized fuel pipe 12 adjacent the outlet 16 and may be held in place using stand-offs 204. The outer wall of the concentrator 202 and the inner wall 24 of the pulverized fuel pipe 12 define therebetween an annular passageway 206, as discussed hereinafter. In an embodiment, the outside diameter of the concentrator 202 is approximately equal to the outside diameter of the igniter lance 18 such that the annular passageway 206 is approximately equivalent in cross-sectional area to the annular gap 20. The pulverized fuel concentrator 202 supports fuel concentration and ignition utilizing the igniter lance 18.

In particular, as illustrated in FIG. 4, the igniter lance 18 may be moved to its fully forward position, denoted by the dashed lines, such that the forward end of the igniter lance 18 substantially abuts or nearly abuts the rearward end of the pulverized fuel concentrator 202. In this position, the annular gap 20 and the annular passageway 206 define together a substantially continuous passageway or gap for the flow of the mixture of pulverized fuel and primary air into the combustion chamber 26 of the boiler. This positioning may be desired when stable operation is achieved, and provides a highly concentrated flow of pulverized fuel and air into the combustion chamber, thereby supporting low-$NO_x$ combustion.

Figure 5:
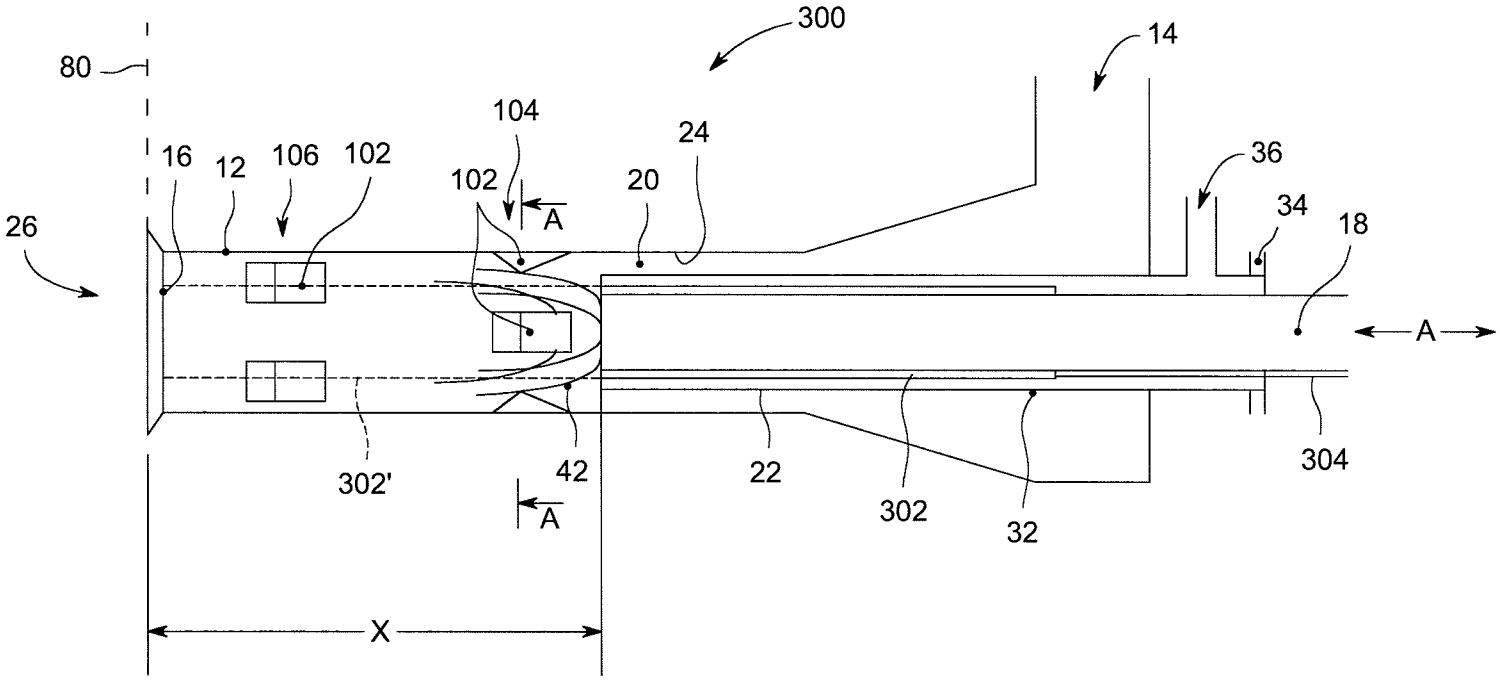
FIG. 5 is a schematic illustration of a system for solid fuel ignition, according to another embodiment of the invention.

Referring finally to FIG. 5, a portion of a burner 300 according to another embodiment of the invention is illustrated. The burner 300 is substantially similar to burners 10, 100 described above in connection with FIGS. 1-3, where like reference numerals designate like parts. As illustrated therein, in an embodiment, the burner 300 may also incorporate an axially-movable, telescoping core air tube 302. For example, the core air tube 302 may be received within sleeve 32 and slidably receives therein the igniter lance 18. A control rod 304 may be operatively connected to the core air tube 302 for axially moving the core air tube 302 forward and backward within the sleeve 32. In an embodiment, the control rod 304 may be, for example, a pneumatic, hydraulic, or electric linear actuator. In operation, the core air tube 302 is moveable rearward and forward (as shown by 302') via the control rod 304. For example, once burner operation is stable, the igniter lance 18 to be moved fully rearward and the core air tube 202 may be moved forward in order to extend/maintain the annular gap 20 and therefore achieve low-$NO_x$ combustion. That is, the axially movable core air tube 302 allows the annular gap 20 to be maintained or extended even when the igniter lance 18 is moved rearward, such as during stable burner operation.

The system, method and apparatus of the invention therefore provides for single stage solid fuel ignition where ignition residence time within the single ignition stage may be selectively varied. The invention therefore provides for a heretofore unseen flexibility in solid fuel ignition, improved ignition process control, and a greater level of safety. In particular, the ability to vary ignition residence time improves pulverized fuel ignition performance, providing improved and safe pulverized fuel ignition process control. Moreover, the system and method of the invention obviates the need to use oil or gas for startup operation and to ensure stable operation, thereby decreasing overall operating costs. In addition, by maintaining the presence of the annular gap between the igniter lance and the pulverized fuel pipe in a round burner, low-$NO_x$ combustion can be achieved.

In an embodiment, an ignition system is provided. The ignition system includes a pulverized fuel pipe receiving a mixture of pulverized fuel and primary air for injection into a combustion chamber for combustion, and an igniter received within the pulverized fuel pipe for igniting the mixture. The igniter is axially movable within the pulverized fuel pipe. In an embodiment, the ignition system further includes an annular gap defined between an outer wall of the igniter and an inner wall of the pulverized fuel pipe for receiving the mixture prior to ignition. In an embodiment, the ignition system also includes a moving mechanism coupled to the igniter for axially moving the igniter within the pulverized fuel pipe. In an embodiment, the ignition system forms a portion of a round burner. In an embodiment, the igniter is movable away from an outlet end of the pulverized fuel pipe to increase the ignition residence time, and the igniter is movable towards the outlet end of the pulverized fuel pipe to decrease the ignition residence time. In an embodiment, the igniter is a plasma igniter. In an embodiment, the pulverized fuel is a solid fuel. In an embodiment, the ignition system includes a plurality of angled projections formed on an inner wall of the pulverized fuel pipe, the angled projections being configured to divert at least a portion of the mixture into a flame of the igniter. In an embodiment, the plurality of angled projections are arranged in at least two rows, wherein the projections in one of the rows are radially offset from the projections in another of the rows. In an embodiment, the projections are offset by greater than about 10 degrees. In an embodiment, the ignition system also includes a pulverized fuel concentrator positioned within the pulverized fuel pipe adjacent a outlet end of the pulverized fuel pipe and defining an annular passageway between the pulverized fuel concentrator and the pulverized fuel pipe. When the igniter is moved to a forward position adjacent to the pulverized fuel concentrator, the pulverized fuel concentrator, the igniter and the pulverized fuel pipe form a generally continuous annular gap extending from the igniter to the outlet. In an embodiment, the ignition system includes a core air pipe received within the pulverized fuel pipe, wherein the igniter is received within the core air pipe, and wherein the core air pipe is axially movable within the pulverized fuel pipe for maintaining the annular gap when the igniter is moved axially rearward.

In another embodiment, a method for igniting a solid fuel is provided. The method includes the steps of providing a mixture of pulverized fuel and primary air to a pulverized fuel pipe having an outlet end, igniting the mixture with an igniter received axially within the pulverized fuel pipe, and varying an ignition residence time of the mixture by axially moving the igniter within the pulverized fuel pipe to vary a distance of a forward end of the igniter with respect to the outlet end of the pulverized fuel pipe. In an embodiment, an outer wall of the igniter and an inner wall of the pulverized fuel pipe define an annular gap for receiving the mixture prior to ignition. In an embodiment, the step of varying the ignition residence time includes moving the igniter away from the outlet end of the pulverized fuel pipe to increase the ignition residence time and moving the igniter towards the outlet end of the pulverized fuel pipe to decrease the ignition residence time. In an embodiment, the igniter is a plasma igniter. In an embodiment, the pulverized fuel pipe includes a pulverized fuel concentrator positioned within the pulverized fuel pipe adjacent the outlet end and which defines an annular passageway between the pulverized fuel concentrator and the pulverized fuel pipe. The method may also include the step of moving the igniter to a forward position adjacent to the pulverized fuel concentrator to form a generally continuous annular gap extending from the igniter to the outlet. In an embodiment, the method may also include the step of deflecting the mixture into a flame generated by the igniter with a plurality of angled projections on an inner wall of the pulverized fuel pipe.

In yet another embodiment, a burner for a combustion system is provided. The burner includes a pulverized fuel pipe receiving a mixture of pulverized fuel and primary air for injection into a combustion chamber for combustion, and an igniter received within the pulverized fuel pipe for igniting the mixture. The igniter is movable axially within the pulverized fuel pipe. In an embodiment, the burner may also include a first annular passageway surrounding the pulverized fuel pipe for receiving a flow of secondary air for passage into the combustion chamber, and a second annular passageway surrounding the first annular passageway for receiving a flow of tertiary air for passage into the combustion chamber. In an embodiment, the burner may also include an annular gap defined between an outer wall of the igniter and an inner wall of the pulverized fuel pipe for receiving the mixture prior to ignition. The igniter is movable away from an outlet end of the pulverized fuel pipe to increase the ignition residence time and decrease a longitudinal extent of the annular gap, and is movable towards the outlet end of the pulverized fuel pipe to decrease the ignition residence time and increase the longitudinal extent of the annular gap. In an embodiment, the burner is a round burner.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

This written description uses examples to disclose several embodiments of the invention, including the best mode, and also to enable one of ordinary skill in the art to practice the embodiments of invention, including making and using any devices or systems and performing any incorporated methods. The patentable scope of the invention is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. An ignition system, comprising:

a pulverized fuel pipe receiving a mixture of pulverized fuel and primary air for injection into a combustion chamber for combustion;

an igniter received within the pulverized fuel pipe for igniting the mixture; and a plurality of angled projections formed on an inner wall of the pulverized fuel pipe, the angled projections being configured to divert at least a portion of the mixture into a flame of the igniter;

wherein the igniter is axially movable within the pulverized fuel pipe; and wherein the plurality of angled projections are arranged in at least two rows, wherein the projections in one of the rows are radially offset from the projections in another of the rows.

2. The ignition system of claim 1, further comprising:
an annular gap defined between an outer wall of the igniter and an inner wall of the pulverized fuel pipe for receiving the mixture prior to ignition.

3. The ignition system of claim 2, further comprising:
a moving mechanism coupled to the igniter for axially moving the igniter within the pulverized fuel pipe.

4. The ignition system of claim 3, wherein:
the ignition system forms a portion of a round burner.

5. The ignition system of claim 4, wherein:
the igniter is movable away from an outlet end of the pulverized fuel pipe to increase the ignition residence time; and
the igniter is movable towards the outlet end of the pulverized fuel pipe to decrease the ignition residence time.

6. The ignition system of claim 2, further comprising:
a core air pipe received within the pulverized fuel pipe;
wherein the igniter is received within the core air pipe; and
wherein the core air pipe is axially movable within the pulverized fuel pipe for maintaining the annular gap when the igniter is moved axially rearward.

7. The ignition system of claim 1 wherein:
the igniter is a plasma igniter.

8. The ignition system of claim 1 further comprising:
an inlet in the igniter for receiving circumferential air into an interior of the igniter, the circumferential air being controllable to selectively increase or decrease pulverized fuel ignition.

9. The ignition system of claim 1, wherein:
the projections are offset by greater than about 10 degrees.

10. An ignition system, comprising:
a pulverized fuel pipe receiving a mixture of pulverized fuel and primary air for injection into a combustion chamber for combustion;
an igniter received within the pulverized fuel pipe for igniting the mixture; and
a pulverized fuel concentrator positioned within the pulverized fuel pipe adjacent an outlet end of the pulverized fuel pipe and defining an annular passageway between the pulverized fuel concentrator and the pulverized fuel pipe;
wherein the igniter is axially movable within the pulverized fuel pipe; and
wherein when the igniter is moved to a forward position adjacent to the pulverized fuel concentrator, the pulverized fuel concentrator, the igniter and the pulverized fuel pipe form a generally continuous annular gap extending from the igniter to the outlet.

11. A method for igniting a solid fuel, comprising the steps of:
providing a mixture of pulverized fuel and primary air to a pulverized fuel pipe having an outlet end;
igniting the mixture with an igniter received axially within the pulverized fuel pipe; and
varying an ignition residence time of the mixture by axially moving the igniter within the pulverized fuel pipe to vary a distance of a forward end of the igniter with respect to the outlet end of the pulverized fuel pipe;
wherein the pulverized fuel pipe includes a pulverized fuel concentrator positioned within the pulverized fuel pipe adjacent the outlet end and which defines an annular passageway between the pulverized fuel concentrator and the pulverized fuel pipe; and
wherein the method further includes the step of moving the igniter to a forward position adjacent to the pulverized fuel concentrator to form a generally continuous annular gap extending from the igniter to the outlet.

12. The method according to claim 11, wherein:
an outer wall of the igniter and an inner wall of the pulverized fuel pipe define an annular gap for receiving the mixture prior to ignition.

13. The method according to claim 11, wherein:
the step of varying the ignition residence time includes moving the igniter away from the outlet end of the pulverized fuel pipe to increase the ignition residence time and moving the igniter towards the outlet end of the pulverized fuel pipe to decrease the ignition residence time.

14. The method according to claim 11, wherein:
the igniter is a plasma igniter.

15. The method according to claim 11, further comprising the step of:
deflecting the mixture into a flame generated by the igniter with a plurality of angled projections on an inner wall of the pulverized fuel pipe.

* * * * *